United States Patent [19]

Ream et al.

[11] Patent Number: 4,592,447

[45] Date of Patent: Jun. 3, 1986

[54] MOVABLE PEDESTAL SCAFFOLD

[75] Inventors: Michael D. Ream, Lafayette; Paul C. Guignard, Concord, both of Calif.

[73] Assignee: Up-Right, Inc., Berkeley, Calif.

[21] Appl. No.: 781,221

[22] Filed: Sep. 27, 1985

[51] Int. Cl.[3] ..... E04G 1/22; E04G 1/24

[52] U.S. Cl. ..... 182/127; 182/16; 182/63; 182/141; 280/5.3; 180/8.2

[58] Field of Search ..... 182/17, 63, 141, 127, 182/145, 16

[56] References Cited

U.S. PATENT DOCUMENTS

| | | | |
|---|---|---|---|
| 2,192,396 | 3/1940 | Burch | 280/5.3 |
| 3,612,218 | 10/1971 | Blair | 182/127 |
| 3,907,138 | 9/1975 | Rhodes | 280/5.3 |
| 4,044,857 | 8/1977 | Guerette | 182/127 |
| 4,183,423 | 1/1980 | Lewis | 182/127 |
| 4,194,591 | 3/1980 | Fisher | 182/17 |
| 4,310,166 | 1/1982 | Eicher | 280/5.28 |
| 4,397,373 | 8/1983 | Ream | 182/127 |

*Primary Examiner*—Reinaldo P. Machado

*Attorney, Agent, or Firm*—Phillips, Moore, Lempio & Finley

[57] ABSTRACT

A movable pedestal scaffold having two sets of wheels on the scaffold base to permit the scaffold to be rolled horizontally while the mast of the scaffold is in a vertical position. A transport frame is mounted for vertical movement on the mast, with such movement being powered by a hydraulic cylinder. A first set of wheels is mounted on the transport frame to support the scaffold at (1) a tilted position relatively near to vertical when the transport frame is close to the base member, and (2) at a tilted position substantially inclined from vertical when the transport frame is away from the base member. A second set of wheels is mounted on the transport frame closer to the mast and to the base frame then the first set of wheels on the transport frame, the first and second sets of wheels on the transport frame acting together to support the scaffold on an elevated horizontal surface as the scaffold is raise to or lowered from that surface.

5 Claims, 10 Drawing Figures

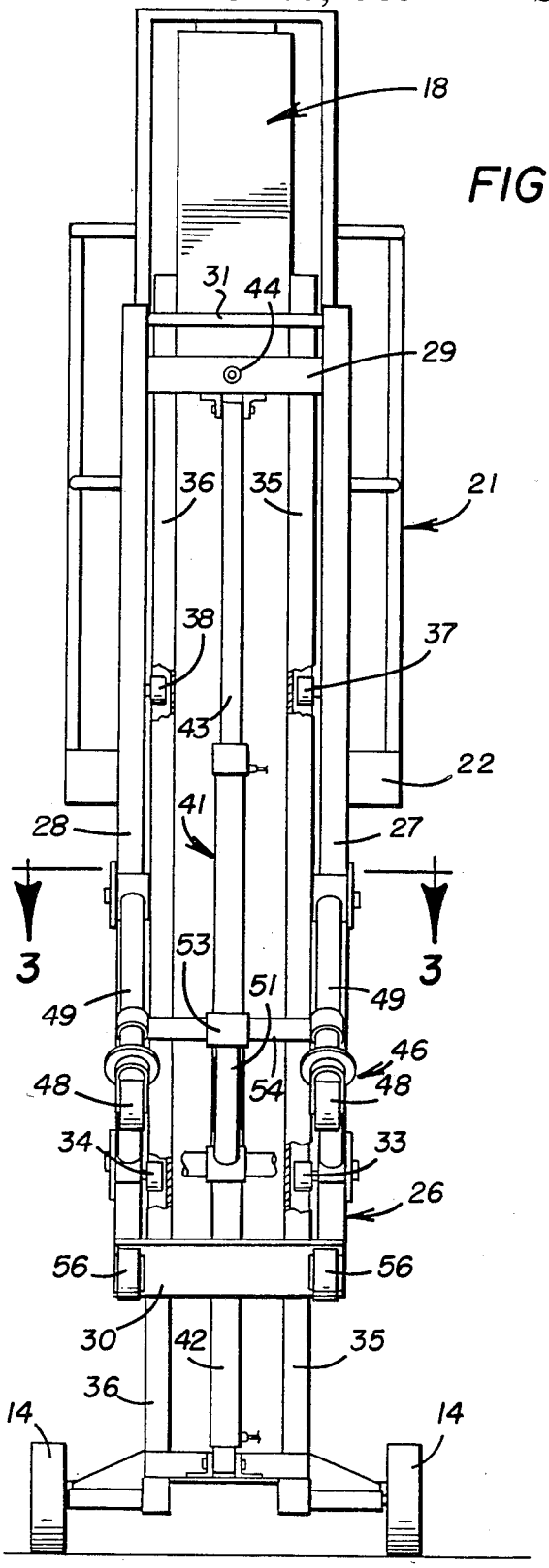
FIGURE 2
FIGURE 3
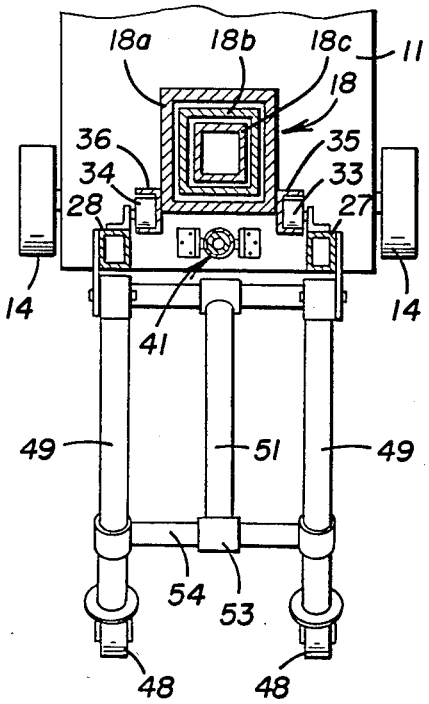

MOVABLE PEDESTAL SCAFFOLD

TECHNICAL FIELD

This invention relates to movable pedestal type scaffold units such as are shown in U.S. Pat. Nos. 4,194,591, issued Mar. 25, 1980, and 4,397,373, issued Aug. 9, 1983.

BACKGROUND ART

Pedestal type scaffolds, as exemplified in the above patents, typically have an upright mast mounted on a relatively small base member, and a work cage mounted on the mast for vertical movement. The base member is provided with two sets of caster wheels to enable the scaffold to be rolled horizontally while the mast is in its vertical work position.

This type scaffold is also typically provided with a transport set of caster wheels which enables the scaffold unit to be tilted over so that it is supported on the transport set and on one of the two sets of base casters, with the mast being substantially inclined from vertical. In this mode, the overall height of the pedestal scaffold is considerably reduced so that it can easily pass through areas of low overhead clearance, such as doorways. Also, the wheelbase defined by the transport set and one base set of caster wheels is considerably greater than the wheelbase of the two base sets of caster wheels so that the scaffold unit is much more stable when it is in the transport mode.

Pedestal scaffolds as described above have a drawback in that when the scaffold is tilted over from its upright working position to its transport position, the workman must himself support a considerable amount of weight after the scaffold has been tipped over and until the transport casters touch the floor or ground. The greater the final inclination from vertical of the mast when in the transport position, and the greater the wheelbase when in transport position, the greater the weight that the workman will have to support.

Additionally, pedestal scaffolds are relatively difficult to move from one horizontal level to another, such as from the ground to a loading dock or to a truck bed. This difficulty is increased when the scaffold unit is fully self contained, with its own hydraulic system, electrically driven pumps and storage batteries. In such case the scaffold unit may weigh in the order of 600 pounds, requiring a number of workmen, or special equipment, to load or unload the scaffold from a truck.

DISCLOSURE OF THE INVENTION

The present invention is directed towards overcoming one or more of the problems set forth above.

In one aspect of the invention, a transport frame is mounted on the mast for powered movement towards and away from the base, the transport frame having a set of transport casters mounted thereon to support the scaffold at a relatively small inclination from vertical when the transport frame is close to the base member. The scaffold can then be lowered further, with full support by the transport casters, by moving the transport frame along the mast and away from the base member.

In a further aspect of the invention, a second set of casters is mounted on the transport frame, the second set of casters being closer to the mast and the base member than the first set of transport casters, the second set of casters being used to support the scaffold as it is raised or lowered relative to a truck bed, for example.

Other aspects of the invention will be set forth in the course of the following detailed description.

BRIEF DESCRIPTION OF THE DRAWINGS

FIG. 2 is a rear elevational view of the pedestal scaffold of FIG. 1, with the transport frame in an elevated position.

FIG. 3 is a sectional view of the mobile scaffold, taken on line 3—3 of FIG. 2.

DESCRIPTION OF THE PREFERRED EMBODIMENT

Figure 1:
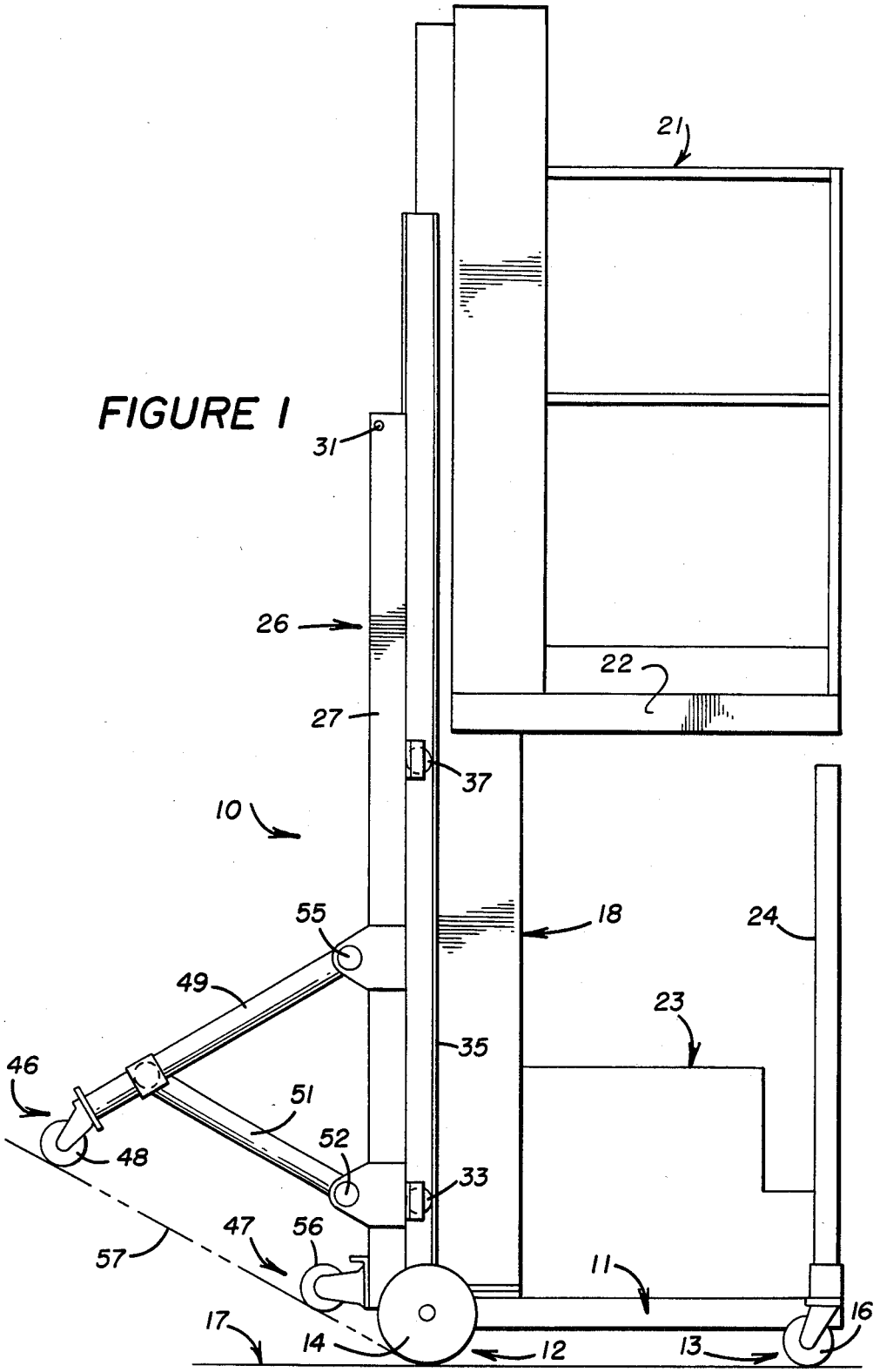
FIG. 1 is a side elevational view of a movable pedestal scaffold constructed in accordance with the present invention.

Referring now to the drawings, wherein is illustrated a preferred embodiment of the invention, FIGS. 1–3 show a movable pedestal scaffold 10 having a wheeled base member 11, with a first wheel means 12 at one end of the base member 11 and a second wheel means 13 at the other end. The wheel means 12 includes a pair of spaced-apart coaxial caster wheels 14, one on each side of the base member 11. The second wheel means 13 includes at least one caster wheel 16, and preferably two such caster wheels, one on each side of the base member 11. Preferably, the caster wheels 16 are mounted on the base member 11 for turning movement about vertical axes so that the scaffold can be steered as it is moved. For purposes of definition, the ground engaging lower surfaces of the first and second wheel means 12 and 13 define a work plane 17.

At one end of the base member 11, an elongated mast 18 extends upwardly, generally perpendicular to the work plane 17. As indicated in FIG. 3, the mast 18 comprises telescoped mast sections 18*a*, *b* and *c*, arranged for vertical extension and retraction by conventional mechanism (not shown). A work cage 21, having a work platform 22, is carried on the innermost mast section. Also carried on the base member 11, as generally indicated at 23, is apparatus for powering the elevation of the telescopic masts 18 and the work cage 21. Typically, such apparatus will include a hydraulic reservoir, a fluid pump and batteries for driving the pump. Also included on the base member 11 is a ladder 24 to enable a workman to climb up to the work cage 21 when the cage is at its downwardly retracted location illustrated in the drawings.

A generally rectangular transport frame 26 is mounted on mast 18 for movement thereon in a direction generally perpendicular to the work plane 17. As best seen in FIGS. 2 and 3, frame 26 comprises two parallel structural tubes 27 and 28 connected together, at their upper and lower ends by structural cross-pieces 29 and 30. Also extending between the upper ends of frame tubes 27 and 28 is a handle 31 of a convenient diameter for a workman to grasp.

As best seen in FIGS. 2 and 3, the two frame tubes 27 and 28 carry a lower set of rollers 33 and 34 disposed for rolling movement in channels 35 and 36 which are fixed to mast 18 and extend along most of the height of the outermost mast section 18*a*. An upper set of rollers 37 and 38 are likewise mounted on frame tubes 27 and 28 for rolling movement in channels 35 and 36.

A hydraulic cylinder 41 is provided for moving the transport frame 26 along mast 18 and for holding the frame on the mast at selected spacings from the work plane 17, the cylinder 41 having its housing 42 secured to base member 11 and its extendible piston rod 43 secured to the upper cross-piece 29 of the transport frame 26. An activating switch 44 is mounted on cross-piece 29, in close proximity to handle 31, the switch being suitably connected in the control circuit for the hydraulic apparatus, so that a workman can cause the piston rod 43 to extend or retract to desired positions. As is conventional, when the hydraulic cylinder is neither extending or retracting, it is hydraulically locked against movement.

The transport frame 26 has mounted thereon a third wheel means 46 and a fourth wheel means 47. The third wheel means 46 includes at least one steerable caster wheel 48 and preferably two such wheels, as shown in the preferred embodiment. In particular, wheels 48 are mounted at the ends of structural tubes 49, tubes 49 being held in the illustrated position by support tube 51 which is connected at one and to the transport frame 26 for pivoted movement about a horizontal axis 52 and connected by coupling 53 at its other end to cross-piece 54 extending between wheel support tubes 49. The coupling 53 is preferably of the quick-disconnect type and the wheel support tubes 49 are preferably connected to frame 26 for pivotal movement about horizontal axis 55 so that the wheel support tubes 49 and support tube 51 can be conveniently folded flat against the transport frame 26 when not in use.

Wheel means 47 comprises a pair of spaced-apart co-axial wheels 56 mounted on the transport frame 26 with the axis of wheels 56 being parallel to the axis of wheels 12 on the base member 11.

As may be noted in the drawings, the third wheel means 46 is mounted on the transport frame 26 for movement therewith, and the third wheel means 46 is spaced away from mast 18 and away from the work plane 17. The wheels 56 of the fourth wheel means 47 are closer to mast 18 and work plane 17 than the third wheel means 46. For purposes of definition, the ground-engageable rolling surfaces of the wheels of the third and fourth wheel means 46 and 47 define a second plane 57 (shown in phantom in FIG. 1) which is inclined to work plane 17. Also, as will be discussed in more detail below in connection with FIGS. 4–6, the ground-engageable rolling surfaces of the wheels of the first and third wheel means 12 and 46 define a transport plane 58. When the frame 26 is at its lowest position on mast 18, the second plane 57 and the transport plane 58 are co-planar.

OPERATION

At a given work-site, the movable scaffold 10 will be in upright position, as shown in FIG. 1, with all of the wheels 14 and 16 on the ground. After the scaffold has been positioned at the particular location desired, the base member 11 is leveled and suitable outriggers (not shown) are extended and locked into place. A workman can now climb up into the work cage 21 and cause the mast 18 to extend and elevate the work cage to a desired height. After the job is done, the mast is retracted and the workman can descend from the scaffold.

If further work needs to be done in the vicinity, the scaffold can be easily moved, on wheels 14 and 16, to another location.

Figure 5:
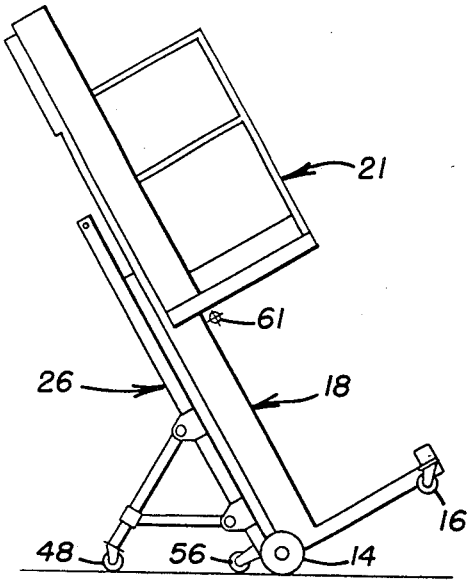
FIGS. 4, 5, and 6 are simplified side views of the pedestal scaffold of FIG. 1, illustrating the manner in which the scaffold can be lowered for rolling transport.
Figure 4:
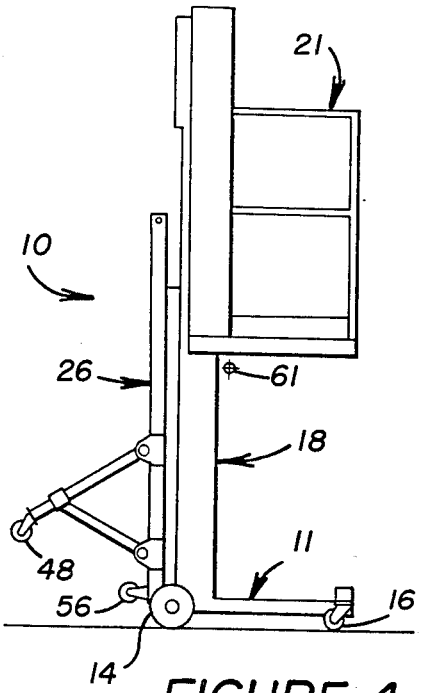
Figure 6:
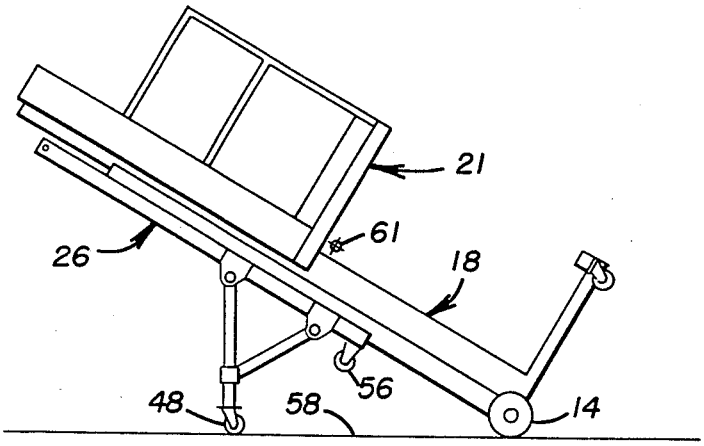

If the scaffold is to be moved to a more remote location, or if the scaffold is to be moved through a doorway, the scaffold can easily be put into the transport mode, as shown in FIGS. 4–6.

As seen in FIG. 4, the scaffold has its mast perpendicular to the floor, with wheels 14 and 16 on the floor, and with the work cage 21 and transport frame 26 in their lowered positions. The entire scaffold 10 is constructed so that its center of gravity, indicated at 61, is vertically within the boundary defined by the points of contact of wheels 14 and 16 with the floor, and preferably relatively near the vertical plane of the axis of wheels 14 when the work cage is unoccupied.

The workman can now stand in back of the scaffold, i.e., on the side of the mast 18 away from the work cage, grasp the handle 31 on frame 26 and tilt the scaffold rearwardly so that the wheels 48 come into engagement with the floor. At this time, the center of gravity 61 of the scaffold is vertically within the support area defined by the engagement points of wheels 14 and 48 with the floor. As mentioned previously, the entire scaffold unit 10 will weigh in the order of 600 pounds, but a workman may easily tilt the scaffold between the positions of FIGS. 4 and 5, since the center of gravity remains relatively close to the vertical plane through the axes of wheels 14.

By actuating the control switch 44, the workman may then cause hydraulic cylinder 41 to extend and move the transport frame 26 upwardly on mast 18. As will be noted in FIG. 6, this will cause wheels 48 and 14 to move away from each other so that the wheel base is lengthened and so that the mast 18 becomes more and more inclined from vertical. As this occurs, the overall vertical height of the scaffold decreases. During this time, the weight of the scaffold remains fully supported by wheels 14 and 46, and none is borne by the workman.

With frame 26 moved to its upward extent on mast 18, the scaffold is in its fully lowered position for transport.

The scaffold 10 can be raised from its FIG. 6 position by causing the hydraulic cylinder 41 to retract. As it does so, it will pull transport frame 26 down on the mast 18, causing the wheelbase defined by wheels 46 and 14 to shorten and the mast to increase its inclination to the floor. When the frame 26 has moved all the way down on mast 18, the scaffold will be in the position shown in FIG. 5. The workman can then easily push against the upper part of the scaffold so that the scaffold comes to the working position of FIG. 4.

FIGS. 7–10 illustrate the manner in which the scaffold 10 can be raised or lowered from one horizontal level to another, such as from ground level 66 to the elevated surface 67 of a loading dock.

Figure 7:
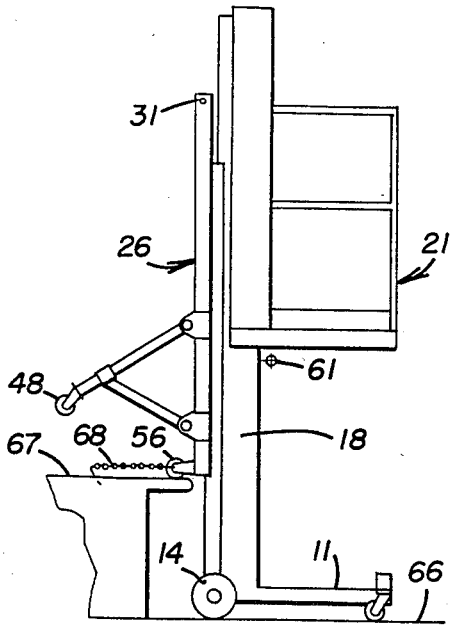
Figure 10:
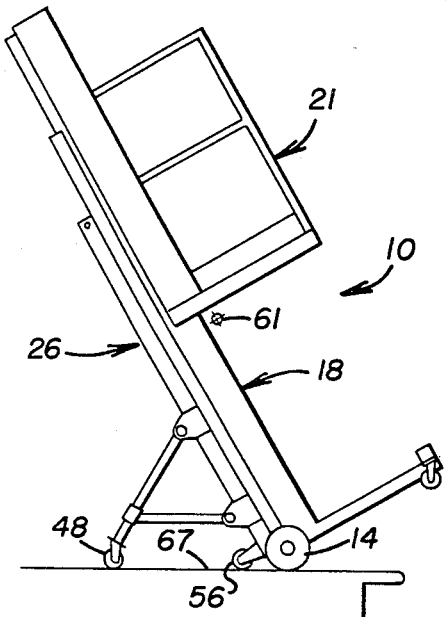

FIG. 7 shows the scaffold 10 on the ground 66 and backed up to the loading dock. The transport frame 26 has been elevated on mast 18 so that the wheels 56 have been raised to the level of the loading dock surface 67. Preferably, a chain 68 is used to connect between the transport frame 26 and a suitable anchor spot on the loading dock to prevent movement of wheels 56 to the right.

Figure 8:
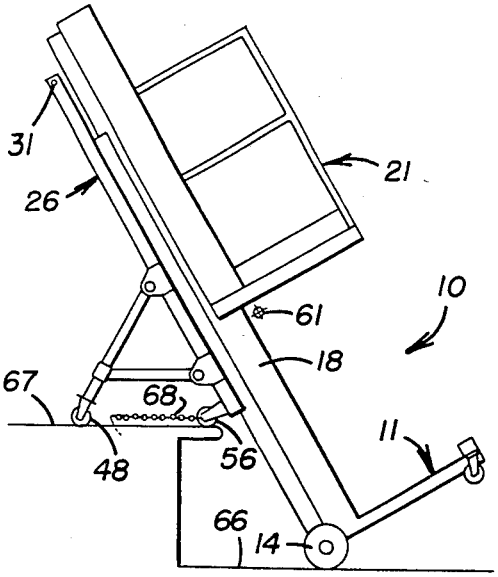
FIGS. 7–10 are simplified side views of the scaffold of FIG. 1, illustrating the manner in which the scaffold may be moved to an elevated surface.

The workman will now simultaneously pull to the left on handle 31 while actuating switch 44 to cause the hydraulic cylinder 41 to extend. As this is done, the entire scaffold will pivot about wheels 56, with wheels 14 rolling to the right on the ground 66. This movement is continued until the frame wheels 48 also come down into engagement with the loading dock surface 67, as shown in FIG. 8.

Figure 9:
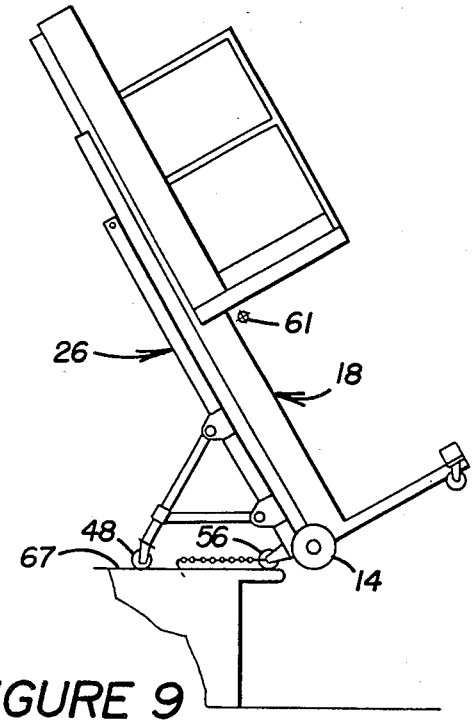

The workman will now cause the hydraulic cylinder to retract, causing the base 11 and mast 18 to move up relative to the transport frame 26. When the frame 26 is finally at its lower-most position on mast 18, as illustrated in FIG. 9, the wheels 12 are tangent to the plan defined by wheels 48 and 58, i.e., they are at the level of the loading dock surface 67.

The scaffold is then rolled to the left, so that the base member wheels 14 are moved onto the loading dock surface. If desired, the scaffold may now be lowered to the transport position illustrated in FIG. 6, or raised to the working position of FIG. 4.

The scaffold 10 may be lowered from a loading dock to the ground in a reverse manner. That is, the scaffold in a FIG. 10 position is rolled to the edge of the dock so that the wheels 14 extend past the edge of the dock (FIG. 9). The hydraulic cylinder 41 is extended, causing the scaffold to move down to the ground (FIG. 8). Retraction of the hydraulic cylinder 41 will now cause the wheels 14 to roll to the left because of the pendulum action as the distance between wheels 56 and 14 decreases. In due course, the scaffold will reach the position of FIG. 7, with wheels 14 and 16 all on the ground. The scaffold can now be rolled on the ground to the right so that frame 26 may be lowered on the mast.

In like manner, the scaffold 10 may be raised onto or lowered from the bed of a pickup truck.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others in the art to best utilize the invention in various embodiments and with various modifications as are suited to the particular use contemplated. It is intended that the scope of the invention be defined by the claims appended hereto.

We claim:

1. A movable pedestal scaffold comprising:

a base member having first and second ends, first and second wheel means having ground engageable positions defining a work plane, said first wheel means including a pair of spaced-apart coaxial wheels, and said second wheel means including at least one wheel, means mounting said first wheel means at the first end of said base member and mounting said second wheel means at the second end of said base member, an elongated mast on said base member at the first end thereof and extending generally perpendicular to said work plane, a work platform carried on said mast, a transport frame mounted on said mast for movement thereon in a direction generally perpendicular to said work plane, means for moving said transport frame along said mast and for holding said transport frame on said mast at selected spacings from said work plane, third wheel means including at least one wheel, means mounting said third wheel means on said transport frame for movement therewith and with said third wheel means being spaced away from said mast and away from said work plane.

2. A movable pedestal scaffold as set forth in claim 1, wherein said means for moving said transport frame along said mast includes a hydraulic cylinder having one end connected to said base member and its other end connected to said transport frame.

3. A mobile scaffold as set forth in claim 1 and further including:

fourth wheel means including a pair of spaced-apart co-axial wheels, means mounting said fourth wheel means on said transport frame, with the axis of the wheels of said fourth wheel means being parallel to the axis of said wheels of said first wheel means, and with the wheels of said fourth wheel means being closer to said mast and to said work plane than said third wheel means, and with the wheels of said third and fourth wheel means defining a second plane inclined to said work plane.

4. A mobile scaffold as set forth in claim 3 wherein said transport frame is mounted on said mast for movement to a position thereon wherein said wheels of said first wheel means is tangent to said second plane.

5. A mobile scaffold as set forth in claim 1 wherein said first and third wheel means define a transport plane, wherein said mobile scaffold is constructed so that its center of gravity is vertically within the area bounded by the wheels of said first and second wheel means when said scaffold is positioned with said work plane being horizontal, and is vertically within the area bounded by the wheels of said first and third wheel means when said scaffold is positioned with said transport plane being horizontal.

* * * * *